US009218716B2

(12) United States Patent
Barclay et al.

(10) Patent No.: US 9,218,716 B2
(45) Date of Patent: Dec. 22, 2015

(54) INTEGRATING SOCIAL NETWORKS AND WAGERING GAMES

(75) Inventors: Brian J. Barclay, Atlanta, GA (US); Andrew C. Guinn, Chicago, IL (US); Jeffrey D. Hofer, Chicago, IL (US); Richard T. Schwartz, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 16 days.

(21) Appl. No.: 13/262,018

(22) PCT Filed: Apr. 1, 2010

(86) PCT No.: PCT/US2010/029722

§ 371 (c)(1),
(2), (4) Date: Sep. 29, 2011

(87) PCT Pub. No.: WO2010/115063

PCT Pub. Date: Oct. 7, 2010

(65) Prior Publication Data

US 2012/0028718 A1 Feb. 2, 2012

Related U.S. Application Data

(60) Provisional application No. 61/166,474, filed on Apr. 3, 2009.

(51) Int. Cl.
*G07F 17/32* (2006.01)

(52) U.S. Cl.
CPC ..... *G07F 17/3255* (2013.01); *G07F 17/3218* (2013.01); *G07F 17/3223* (2013.01); *G07F 17/3232* (2013.01); *G07F 17/3237* (2013.01); *G07F 17/3272* (2013.01); *A63F 2300/572* (2013.01)

(58) Field of Classification Search
USPC ..... 463/16, 17, 25
See application file for complete search history.

(56) References Cited

U.S. PATENT DOCUMENTS

| | | | | |
|---|---|---|---|---|
| 7,682,239 | B2 * | 3/2010 | Friedman et al. | 463/16 |
| 2006/0258438 | A1 | 11/2006 | Platis | |
| 2007/0077994 | A1 * | 4/2007 | Betteridge | 463/42 |

(Continued)

FOREIGN PATENT DOCUMENTS

| | | |
|---|---|---|
| JP | 2002366971 | 12/2002 |
| WO | WO2009026305 | 2/2009 |
| WO | WO2009042563 | 4/2009 |

OTHER PUBLICATIONS

"PCT Application No. PCT/US2010/029722 International Preliminary Report on Patentability", Mar. 29, 2011 , 15 pages.

(Continued)

*Primary Examiner* — Jay Liddle
(74) *Attorney, Agent, or Firm* — DeLizio Law, PLLC

(57) ABSTRACT

A wagering game system and its operations are described herein. In embodiments, the operations can include determining a wagering game player account and determining a social network account associated with the wagering game player account. The social network account can be associated with a social network. The operations can further include determining one or more applications from the social network that are associated with the social network account. The operations can further include integrating the one or more applications with a wagering game session for the wagering game player account.

20 Claims, 11 Drawing Sheets

(56) References Cited

U.S. PATENT DOCUMENTS

| | | | | |
|---|---|---|---|---|
| 2007/0135208 | A1* | 6/2007 | Betteridge | 463/25 |
| 2007/0265092 | A1* | 11/2007 | Betteridge | 463/42 |
| 2008/0064488 | A1* | 3/2008 | Oh | 463/25 |
| 2008/0318655 | A1 | 12/2008 | Davies | |
| 2010/0004055 | A1* | 1/2010 | Gormley et al. | 463/25 |

OTHER PUBLICATIONS

"PCT Application No. PCT/US2010/029722 International Search Report", Aug. 17, 2010 , 11 pages.

* cited by examiner

INTEGRATING SOCIAL NETWORKS AND WAGERING GAMES

RELATED APPLICATIONS

This application claims the priority benefit of U.S. Provisional Application Ser. No. 61/166,474 filed Apr. 3, 2009.

LIMITED COPYRIGHT WAIVER

A portion of the disclosure of this patent document contains material, which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

TECHNICAL FIELD

Embodiments of the inventive subject matter relate generally to wagering game systems and networks that, more particularly, integrate social networks and wagering games.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, roadside casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers are constantly in need of innovative concepts that can make the online gaming industry appealing and profitable.

SUMMARY

In some embodiments, a method comprises determining a wagering game player account associated with a wagering game network; determining a social network account associated with the wagering game player account, the social network account associated with a social network; determining one or more applications from the social network that are associated with the social network account; integrating the one or more applications with a wagering game session for the wagering game player account; and presenting application data from the one or more applications in a gambling user interface provided by the wagering game network In some embodiments, the one or more applications includes a social network game application, and wherein integrating the one or more applications with the wagering game session comprises, determining a game play outcome from the social network game application, determining a bet on the game play outcome associated with the wagering game player account, transacting the bet using the using the game play outcome of the social network game application, and presenting an indication of the bet in the gambling user interface.

In some embodiments, the social network game application is a non-monetary game application that produces a non-monetary game outcome, and further comprising converting the non-monetary game outcome to a wagering game outcome; and transacting a monetary bet using the wagering game outcome.

In some embodiments, the social network game application is a non-wagering game, and wherein determining the game play outcome comprises, determining a competitive group outcome, and transacting the bet using the competitive group outcome.

In some embodiments, the one or more applications includes a social network group game application, wherein integrating the one or more applications with the wagering game session comprises, integrating the wagering game player account and one or more additional social network user accounts into the social network group game application, determining a game play outcome, from the social network group game application, transacting one or more bets for the wagering game player account using the game play outcome, and providing non-wagering functionality to the one or more additional social network user accounts.

In some embodiments, integrating the one or more applications with the wagering game session comprises integrating one or more non-game social network website applications with a wagering game website session for the wagering game player account.

In some embodiments, one or more machine-readable storage media having instructions stored thereon, which when executed by a set of one or more processors causes the set of one or more processors to perform operations comprises determining a wagering game player account controlled by a wagering game server; presenting a gambling user interface on a device connected to the wagering game player account; determining non-wagering activity indicated by the wagering game player account via the gambling user interface, wherein the non-wagering activity is electronically trackable; determining betting amounts associated with the non-wagering activity; determining that a player performs the non-wagering activity via electronic tracking of the non-wagering activity; transacting a bet on a wagering game on behalf of the wagering game player account for the non-wagering activity performed; determining a wagering game outcome for the wagering game; and notifying the wagering game player account of the wagering game outcome via the gambling user interface.

In some embodiments, said operation of transacting the bet for the non-wagering activity includes operations further comprising transacting the bet automatically for the wagering game player account as a direct result of the non-wagering activity performed by the wagering game player account.

In some embodiments, the non-wagering-activity is a social communication activity, and wherein the operation for determining the non-wagering activity indicated by the wagering game player account includes operations further comprising determining a social communication mechanism, indicated by the wagering game player account, that is used to perform the social communication activity; and determining that the wagering game player account performs the social communication activity using the social communication mechanism.

In some embodiments, the non-wagering activity comprises one or more of sending messaging media, posting a blog entry, making an update to a social network account, configuring blog aggregation, and making a telephone call.

In some embodiments, the one or more machine-readable media said operations further comprises presenting a configuration interface for the wagering game player account to pre-set one or more of a bet value for the non-wagering activity, a betting limit on the non-wagering activity, and a preference for the wagering game.

In some embodiments, said operation for notifying the wagering game player account of the wagering game outcome includes operations comprising: determining a representation of the wagering game outcome; providing the representation of the wagering game outcome to a social network application associated with a social network to which the wagering game player account belongs; determining a player accesses the social network application; and presenting the representation of the wagering game outcome on the social network application.

In some embodiments, the one or more machine-readable storage media said operations further comprises determining a win amount for the wagering game outcome; and updating an account balance for the wagering game player account with the win amount.

In some embodiments, a system comprises a client comprising a social network gaming module configured to present a wagering control mechanism to a social network account, determine a first wager amount from the social network account for an event, wherein the event has a plurality of potential undetermined outcomes, and determine a first potential outcome for the event, indicated by the social network account, on which the social network account desires to place the first wager. The system can also comprise a wagering game server including a gaming controller configured to receive the first wager and the first potential outcome, determine a first wagering game player account associated with the social network account, determine a second wager from a second wagering game player account, determine a second potential outcome of the event indicated by the second wagering game player account, and broker the first wager against the second wager.

In some embodiments, the gaming controller is configured to store the first wager and the second wager in a secured escrow account, determine an event outcome for the event, determine that the first potential outcome was equivalent to the event outcome, and release the funds in the secured escrow account to the first wagering game player account.

In some embodiments, the gaming controller is further configured to release the funds to one or more of a banking account, a non-wagering broker account, and a financial escrow accounts belonging to the first wagering game player account.

In some embodiments, the gaming controller is configured to broker wagers of non-monetary value.

In some embodiments, the event is an occurrence whose outcome is at least partially outside of the control of the first wagering game player account and the second wagering game player account.

In some embodiments, an apparatus comprises a game representation publisher configured to determine a wagering game player account, determine a social network account associated with the wagering game player account, determine a wagering game activity associated with the wagering game, generate a messaging medium content, generate a wagering game representation, associate the wagering game representation with the messaging medium content, determine one or more social contact accounts associated with the social network account, and send the messaging medium content to the one or more social contact accounts.

In some embodiments, the messaging medium content is a text message, and wherein the game representation publisher is further configured to embed the wagering game representation in the text message, determine contact information for the one or more social contact accounts, and send the text message to the one or more social contact accounts using the contact information.

In some embodiments, the wagering game representation includes a link to a game replay, wherein the link is one or more of a written link to a website, an active link to a website, and an active link to a file included with the a message.

In some embodiments, the game representation publisher is further configured to track activity of the one or more social contact accounts that receive and view the wagering game representation.

In some embodiments, an apparatus comprises: means for determining a wagering game player account associated with a wagering game network; means for determining a social network account associated with the wagering game player account, the social network account associated with a social network; means for determining one or more social network applications from the social network that are associated with the social network account; means for determining a game play outcome from a social network game application; means for determining a bet on the game play outcome associated with the wagering game player account; and means for transacting the bet using the using the game play outcome of the social network game application.

In some embodiments, the apparatus further comprises means for transacting the bet automatically for the wagering game player account as a direct result of non-wagering activity performed by the wagering game player account.

In some embodiments, the apparatus further comprises means for determining that the wagering game player account has insufficient funds to transact additional bets; means for determining additional wagering game outcomes; and means for presenting an amount of money that the social network account would have won had the wagering game player account been funded.

BRIEF DESCRIPTION OF THE DRAWING(S)

Embodiments are illustrated in the Figures of the accompanying drawings in which.

DESCRIPTION OF ILLUSTRATIVE EMBODIMENTS

Figure 1:
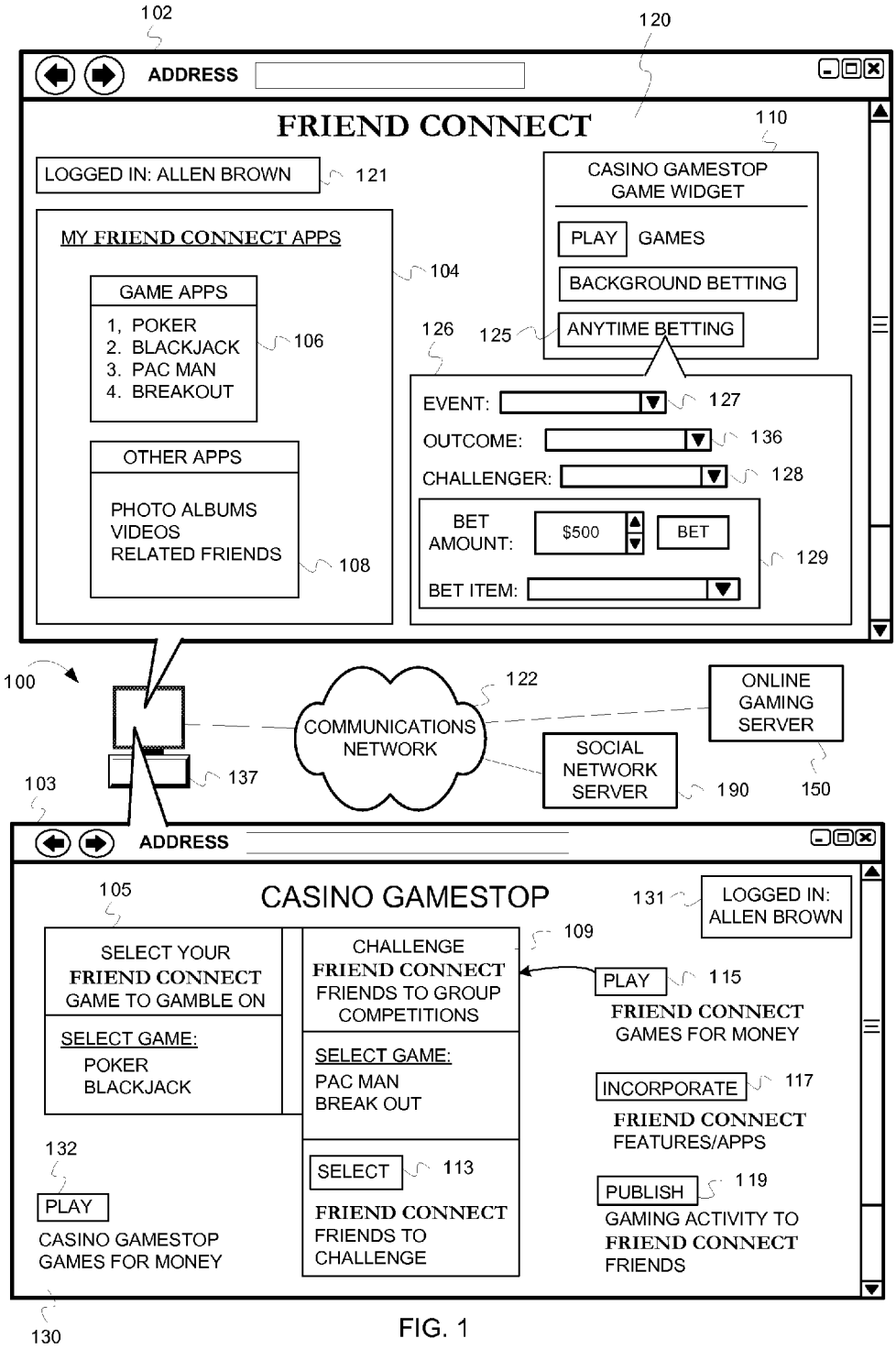
FIG. 1 is an illustration of incorporating social network applications and features into a wagering game venue, according to some embodiments.

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

Social communication is on the rise. Messaging, social networking, blogging, and other electronic social communications are increasing in popularity. Social network applications are appearing online in vast quantities. Internet users are enjoying a proliferation of blogs, microblogs, aggregators, etc. Messaging mediums are exploding in use (e.g., e-mail, instant messenger, SMS text messages, MMS multimedia message, chat messages, etc.). In short, social networking and other forms of electronic social communication mechanisms and devices are popular for many online users. Many of those online users are also wagering game enthusiasts. Wagering games are also expanding in popularity. Many wagering game enthusiasts are demanding greater access to wagering games and content related to wagering games, especially content that includes social networking As stated previously, some wagering game companies have created online wagering game websites that provide a way for wagering game enthusiasts to play wagering games while connected to the Internet (e.g., via a web-browser). Some online wagering game websites provide various features, such as social network functionality. Social networks allow wagering game players ("players") to create user accounts with one or more unique identifiers that represent an online persona. One example of a unique identifier is an "avatar". Avatars are graphical, "cartoon-like" depictions of a social network persona. These online personas and associated avatars add to the fun of belonging to a social network. Many online casinos, however, present an unsatisfactory wagering game experience to players who enjoy a more integrated gaming experience. Embodiments however, present examples of integrating social networks, social community website applications, messaging mediums, blogs, other social communication mechanisms with wagering games and network gaming venues (e.g., online casinos, a wagering game websites, wagering networks, etc.). Embodiments can be presented over any type of communications network (e.g., public or private) that provides access to wagering games, such as a website (e.g., via wide-area-networks, or WANs), a private gaming network (e.g., local-area-networks, or LANs), a file sharing networks, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.). In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling".

FIG. 1 is a conceptual diagram that illustrates an example of incorporating social network applications and features into a wagering game venue, according to some embodiments. In FIG. 1 a wagering game system ("system") 100 includes a computer system ("computer") 137 connected to a communications network 122. The system 100 can also include an online gaming server 150 and a social network server 190, both connected to the communications network 122. The computer 137 presents a first instance of a web browser application ("first browser") 102 and a second instance of the web browser ("second browser") 103. The first browser 102 presents a website for a social network ("social network website") 120. The social network website 120 can include an applications console 104. The applications console 104 can present applications provided by a social network (e.g., a fictitious social network website "Friend Connect"). Some examples of real-world social networking websites include Blogger™, FaceBook™, LinkedIn™, Twitter™, MySpace™, and others. The applications console 104 can include game-related applications 106 and non-game-related applications 108. The game-related applications 106 can include "wagering" type game applications (e.g., Poker, Blackjack, etc.) and non-wagering type game applications (e.g., Pac Man, Breakout, etc.). The social network website 120 provides the game-related applications 106 and the non-game-related applications 108 to one or more of its users (e.g., the social network user "Allen Brown" logged in to the social network website 120 via a social network user account 121). The social network user account 121 can be hosted by the social network server 190. The social network user can also have an associated wagering game player account ("player account") 131 stored in the online gaming sever 150. The second browser 103 presents an online wagering venue, such as an online casino website ("online casino") 130 hosted by the online gaming server 150. The online casino 130 (e.g., a fictitious online casino website "Casino GameStop") can present wagering game content of its own, accessed via a wagering game console 132. The online casino 130 can also integrate, via the system 100, with the social network server 190, which stores the content for the social network website 120. The system 100 can access the social network server 190 and all of its content, including the applications (e.g., the game-related applications 106 and the non-game-related applications 108) and other social network features available from the social network website 120. The system 100 can present the applications on the online casino 130. For instance, the system 100 presents some, or all, of the game-related applications 106 from the social network website 120 that are associated with the social network user account 121. In some embodiments, the system 100 can present the wagering type game applications (e.g., Blackjack, Poker) in a social network gaming console 105 that presents only the wagering, or gambling, type of games that were available to, or that were previously selected or used, by the social network user account 121. The wagering type games from the game-related applications 106 may have been presented on the social network website 120 without gambling functionality, or in other words, only for non-gambling use. The wagering-game type applications can be configured to connect (e.g., interface) across websites. The system 100 can present gambling functionality in conjunction with the wagering type games (e.g., provide a gambling console skin, enable wagering functionality from the applications, add gambling functionality via a plug-in, enable gambling functionality via an application programming interface, etc.). In some embodiments, the online casino 130 can also integrate non-wagering type game applications (e.g., the Pac Man game or the Breakout game) into the online casino 130. The system 100 can present the non-wagering type game applications for wagering purposes, such as for betting on group competitions. The system 100 can present the non-wagering type game applications from the game-related applications 106 in a competition console 109. The player account 131 can challenge friends to group competitions on which the player account 131, any of the friends' accounts, or any other interested accounts, can gamble on the results of the competition. The player account 131 can select friend's accounts (e.g., social contact accounts associated with the social network website 120 and/or other social networks associated with the player account 131) via a competitor selection control 113. The player account 131 can enable the social network gaming console 105 using a social network game control 115. The system 100 can also integrate other applications from the social network website 120 (e.g., via a social network features control 117), such as the non-game-related applications 108 that are associated with the social network user account 121 from the social network website 120. The system 100 can also provide social communication features, such as a publishing control 119 that the player account 131 can use to publish wagering game representations (e.g., game outcome presentations, game replays, etc.) to friends (e.g., social contact accounts, cell phone numbers, email addresses, etc.) associated with the player account 131. In some embodiments, the system 100 can also include a web widget 110 that can integrate into the social network website 120. The web widget 110 can perform various wagering activities (e.g., provide wagering games, provide betting options, etc.) associated with the online casino 130.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
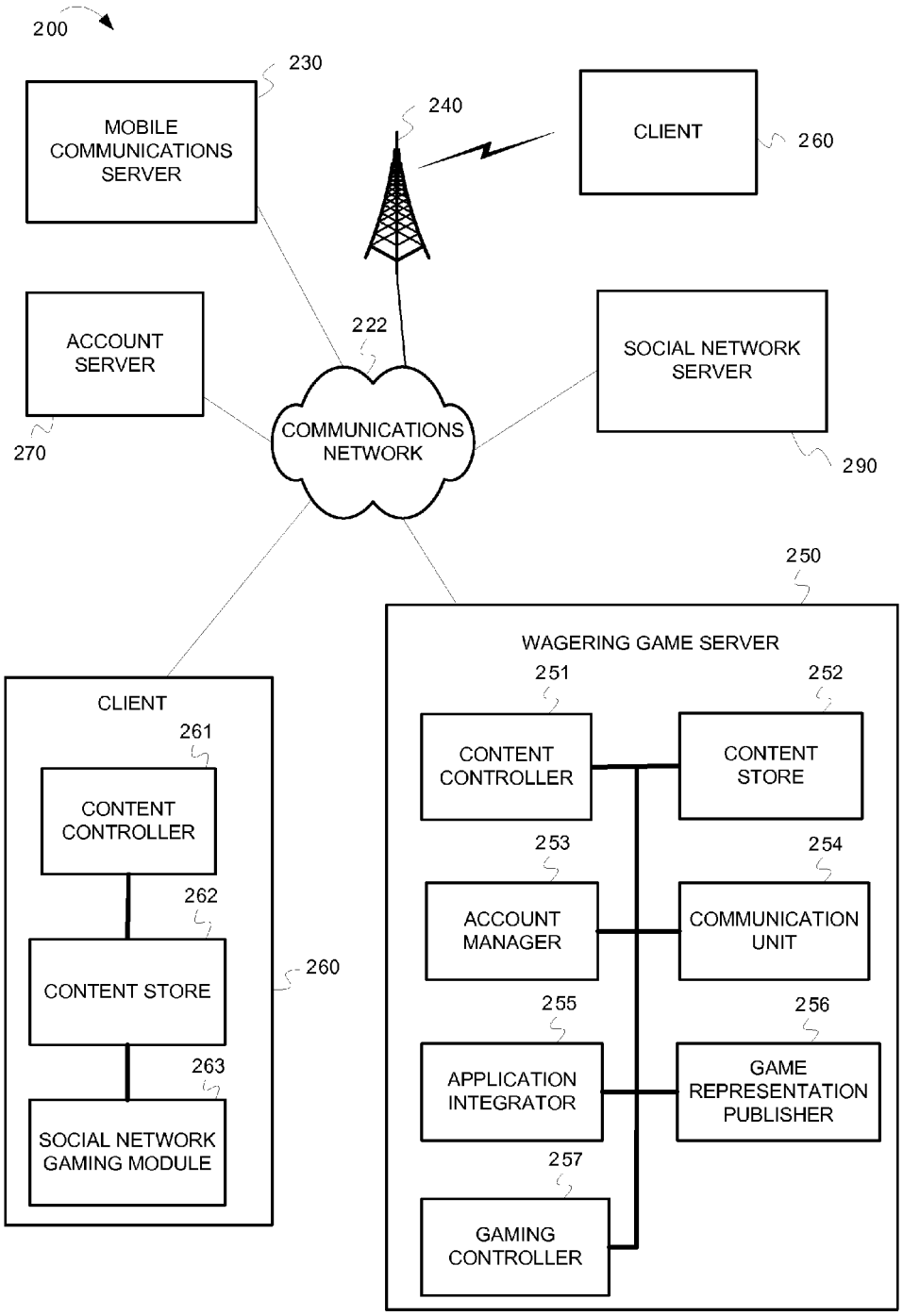
FIG. 2 is an illustration of a wagering game system architecture 200, according to some embodiments.

FIG. 2 is a conceptual diagram that illustrates an example of a wagering game system architecture 200, according to some embodiments. In FIG. 2, the wagering game system architecture 200 can include an account server 270 configured to control user related accounts accessible via wagering game networks and social networks. The account server 270 can store wagering game player account information, such as account settings (e.g., betting settings related to social network background betting, settings related to social network application integration, settings related to game representation publication, etc.), preferences, player profile data, and other information for a player's account. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers.

The wagering game system architecture 200 can also include a wagering game server 250 configured to control wagering game content, provide random numbers, and communicate wagering game information, account information, and other information to and from clients 260. The wagering game server 250 can include a content controller 251 configured to manage and control content for the presentation of content on the clients 260. For example, the content controller 251 can generate game results (e.g., win/loss values), including win amounts, for games played on the clients 260. The content controller 251 can communicate the game results to the clients 260. The content controller 251 can also generate random numbers and provide them to the clients 260 so that the clients 260 can generate game results. The wagering game server 250 can also include a content store 252 configured to contain content to present on the clients 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the clients 260 and to communicate with other systems, devices and networks. The wagering game server 250 can also include an application integrator 255 configured to integrate social network applications with wagering game venues (e.g. gaming websites), integrate wagering game applications with social network venues (e.g., social network websites), apply gaming functionality to social network game applications, etc. The wagering game server 250 can also include a game representation publisher 256 configured to publish, via messaging mediums, widgets, or other devices, wagering game representations (e.g., game outcome representations, game replays, etc.) from player accounts to their associated social network contacts (i.e., social contact accounts). The game representation publisher 256 can generate messaging medium related to results of game play (e.g., can embed a game replay link in an SMS text messages, can embed a game-replay screen shot in an MMS message, etc.). The wagering game server 250 can also include a gaming controller 257 configured to control background betting associated with a player account's non-wagering activities (e.g., social communications, daily tasks, etc.). The gaming controller 257 can also control wagers between social network accounts and wagering game player accounts.

The wagering game system architecture 200 can also include one or more clients ("clients") 260 configured to present wagering games and receive and transmit information to incorporate social networks and wagering games. The clients 260 can be a computer system, a personal digital assistant (PDA), a cell phone, a laptop, a wagering game machine, or any other device or machine that is capable of processing information, instructions, or other data provided via a communications network 222. The clients 260 can include a content controller 261 configured to control wagering games, social network applications, and other content on the clients 260. The clients 260 can also include a content store 262 configured to store content to present on the clients 260. The clients 260 can also include a social network gaming module 263 configured to control presentation of integrated applications, features, etc. from wagering game networks and social networks, send messages of wagering game representations, view messaging media with game replay presentations, access social network venues (e.g., websites), control web widgets, control social network applications, perform peer-to-peer betting, access brokered betting accounts, access wagering game accounts, access social network accounts, etc.

The wagering game system architecture 200 can also include a social network server 290 configured to host social network accounts, provide social network content, control social network communications, store associated social contacts, etc.

The wagering game system architecture 200 can also include a mobile communications server 230 configured to provide and control mobile content and communications, such as messaging media, mobile applications, etc. The mobile communications server 230 can utilize GSM (Global System for Mobile communications) protocols, the Short Message Service (SMS), the Multimedia Messaging Services (MMS), or other communication technologies associated with mobile communications, text messaging, email, instant messaging, mobile applications, etc.

The wagering game system architecture 200 can also include a communications network antenna 240 configured to receive and transmit mobile communications.

Each component shown in the wagering game system architecture 200 is shown as a separate and distinct element connected via the communications network 222. However, some functions performed by one component could be performed by other components. For example, the wagering game server 250 can also be configured to perform functions of the social network server 290, the social network gaming module 263, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the clients 260 instead of, or in addition to, being a part of the wagering game server 250. Further, in some embodiments, the clients 260 can determine wagering game outcomes, generate random numbers, etc. instead of, or in addition to, the wagering game server 250. As mentioned previously, in some embodiments, the clients 260 can take the form of wagering game machines. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, clients and wagering game servers work together such that a client can be operated as a thin, thick, or intermediate client. For example, one or more elements of game play may be controlled by the client or the wagering game servers (server). Game play elements can include executable game code, lookup tables, configuration files, representations of game outcomes, audio or visual representations of the game, game assets or the like. In a thin-client example, the server can perform functions such as determining game outcome or managing assets, while the client can present a graphical representation of such outcome or asset modification to the user (e.g., player). In a thick-client example, the client can determine game outcomes and communicate the outcomes to the server for recording or managing a player's account.

In some embodiments, either the client(s) or the wagering game server(s) can provide functionality that is not directly related to game play. For example, account transactions and account rules may be managed centrally (e.g., by the wagering game server(s)) or locally (e.g., by the client). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
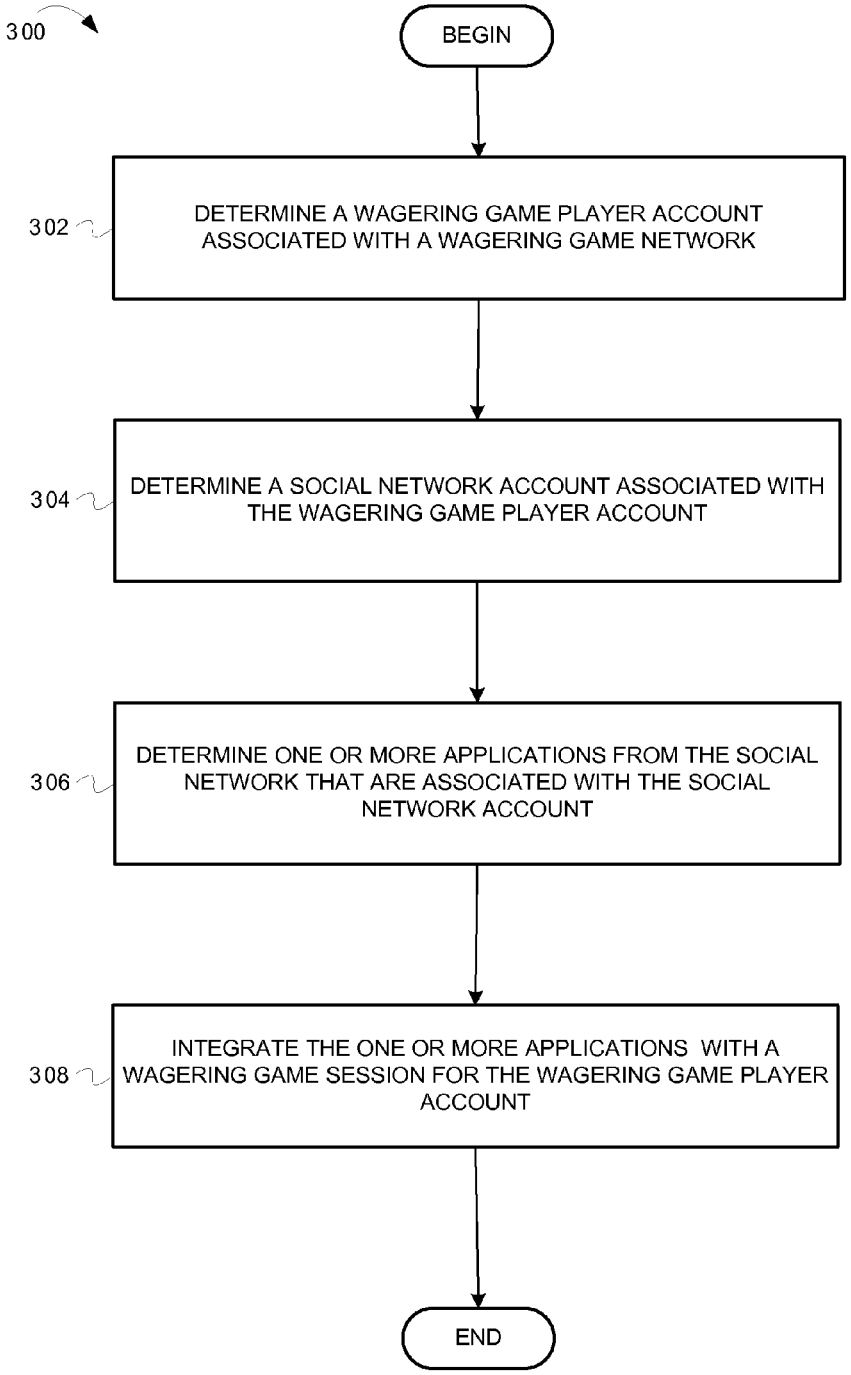
FIG. 3 is a flow diagram 300 illustrating integrating social network applications with a wagering game session, according to some embodiments.

FIG. 3 is a flow diagram ("flow") 300 illustrating integrating social network applications with a wagering game session, according to some embodiments. FIG. 1 is a conceptual diagram that helps illustrate the flow of FIG. 3, according to some embodiments. This description will present FIG. 3 in concert with FIG. 1. In FIG. 3, the flow 300 begins at processing block 302, where a wagering game system ("system") determines a wagering game player account associated with a wagering game network.

The flow 300 continues at processing block 304, where the system determines a social network account associated with the wagering game player account. The system can, in some embodiments, determine a request, from a player account logged in to a wagering game website, to connect to a social network account associated with the player account. The social network account can be associated with a social network website. The player account use stored social network account information (e.g., login information for the social network account) to connect to the social network account. In some embodiments, the system can determine a request, from the social network account logged in to the social networking website, to connect to the player account associated with the social network account. The social network account can use player account information (e.g., login information for the player account) to connect to the player account.

The flow 300 continues at processing block 306, where the system determines one or more applications from the social network that are associated with the social network account. The applications can be game applications or non-game applications. For example, in FIG. 1, the system 100 determines, from the applications console 104, the game-related applications 106 (e.g., Poker, Blackjack, Pac Man, and Breakout) and the non-game applications (e.g., Photo Album, Videos, Related Friends, etc.). The system 100 can read settings for the social network user account 121 in the social network server 190 and access application content stored on the social network server 190.

The flow 300 continues at processing block 308, where the system integrates the one or more applications with a wagering game session for the wagering game player account. For instance, the system can install a web widget in association with the social network account for the social network website. The web widget can integrate with the applications provided by the social network website. The system can activate the web widget when the social network player account connects to a social network website and engages in a social network session. The web widget can also have a login feature for the player account. The player account can login to the wagering game website, online casino, wagering game network, or other wagering game venue using the login feature. The web widget thus connects the player account to the social network account. In some embodiments, the system can activate the web widget when the player logs in to the wagering game website and automatically connects to the social network website via stored social network connection information. The web widget can track activity performed by the social network account or the player account and report activity back and forth between the social network website and the wagering game website. In some embodiments, the system integrates the one or more applications with the wagering game session by integrating one or more of features and activity of a social network website application into a wagering game website session for the wagering game player account (e.g., the system incorporates a photos, comments, updates, etc. from a social network photo album application into a wagering game website). In some embodiments, the system can share events that occur on the wagering game website with multiple associated social network websites (e.g., multiple social network websites that the player account has registered to share information with). In some embodiments, the system can integrate activity from a social network game application into the wagering game session. For example, as described in FIG. 1, the system 100 integrates the game-related applications 106 with the online casino website 130. The player account 131 can play a selected game-related application from the social network website 120 via the online casino website 130. For instance, the system 100 can present the selected game-related application through a game interface (e.g., port the selected game-related application from the social network server 190 and embed it in a wagering framing or gambling user interface) within the second browser 103, on the online casino website 130. The selected game-related application could still be provided by, run by, processed by, etc. the social network server 190. The game interface can integrate with the online gaming server 150 and present gambling features (e.g., betting controls, wagering game account features, etc.) of the online casino website 130. In some embodiments, the system 100 can determine a game play outcome from the selected game-related application and determine a bet on the game play outcome associated with the wagering game player account. For example, the system 100 can read a default bet stored for the player account 131. The system 100 can also prompt the player (e.g., via the game interface) to enter a bet. The system 100 can use funds from the player account 131 to transact the bet. The system 100 can then transact the bet using the game play outcome of the selected game-related application. In some embodiments, the selected game-related application is a wagering game type game (e.g., a Poker game) but is not an actual wagering game application. In other words, the selected game-related application can produce a casual-play game outcome, or a non-monetary outcome that is not derived from cash, or other monetary wagers and that provides non-monetary scores or rewards (e.g., points, a score, etc.). The system 100, however, can convert the casual-play game outcome to a wagering-game outcome and use the wagering-game outcome to transact the bet. In some embodiments, the system 100 can present the selected game-related application from the social network website 120 within the first browser 102, and the system 100 can convey activity performed within the application to the online gaming server 150. The selected game-related application may normally be played casually (e.g., not for cash wagers) when not integrated with the online gaming server 150. However, when integrated, the system 100 can convey the game activity (e.g., game moves, game results, etc.) from the selected game-related application to the online gaming server 150 and the player account 131 can play the selected game-related application for money (e.g., can place cash wagers). In some embodiments, the system 100 can determine a competitive group outcome and use the competitive group outcome to transact the bet. For example, as described previously, the player account 131, or associated social network user account 121, can challenge friends to competitive games and make monetary wagers on the game outcomes. Returning to FIG. 3, in some embodiments, the system can present a group game to one or more social network accounts and can present the same instance of the game to one or more wagering game players accounts. The system can accept wagers from the one or more wagering game player accounts and award those player accounts with monetary compensation for winning bets. At the same time, the system can present the same game to the one or more social network accounts for causal play and can provide non-monetary prizes. In some embodiments, the system can provide non-monetary awards to player accounts and social network accounts that perform social network activity (e.g., chats, inviting friends, etc.).

Figure 4:
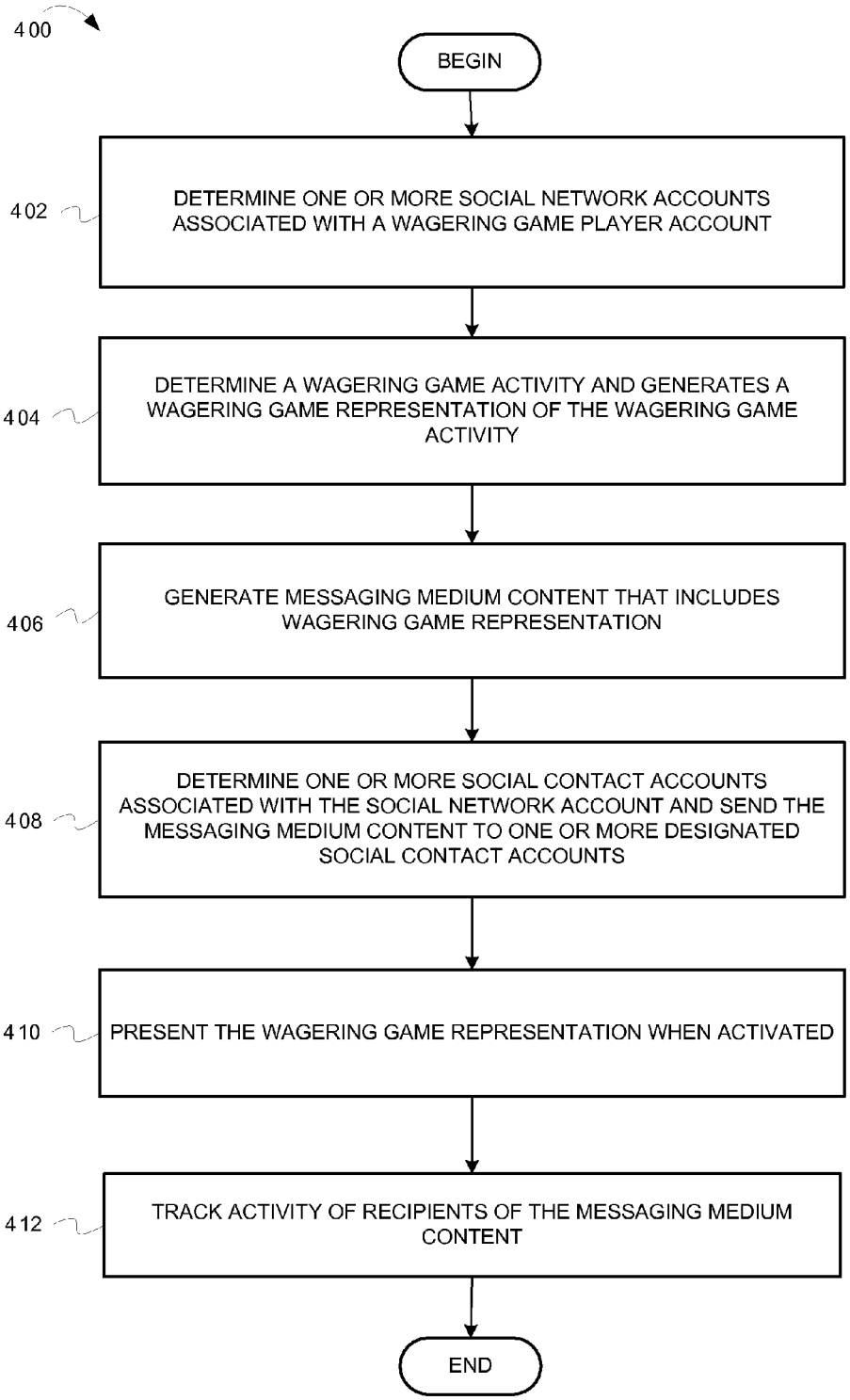
FIG. 4 is a flow diagram 400 illustrating generating messaging with gaming content links, according to some embodiments.
Figure 5:
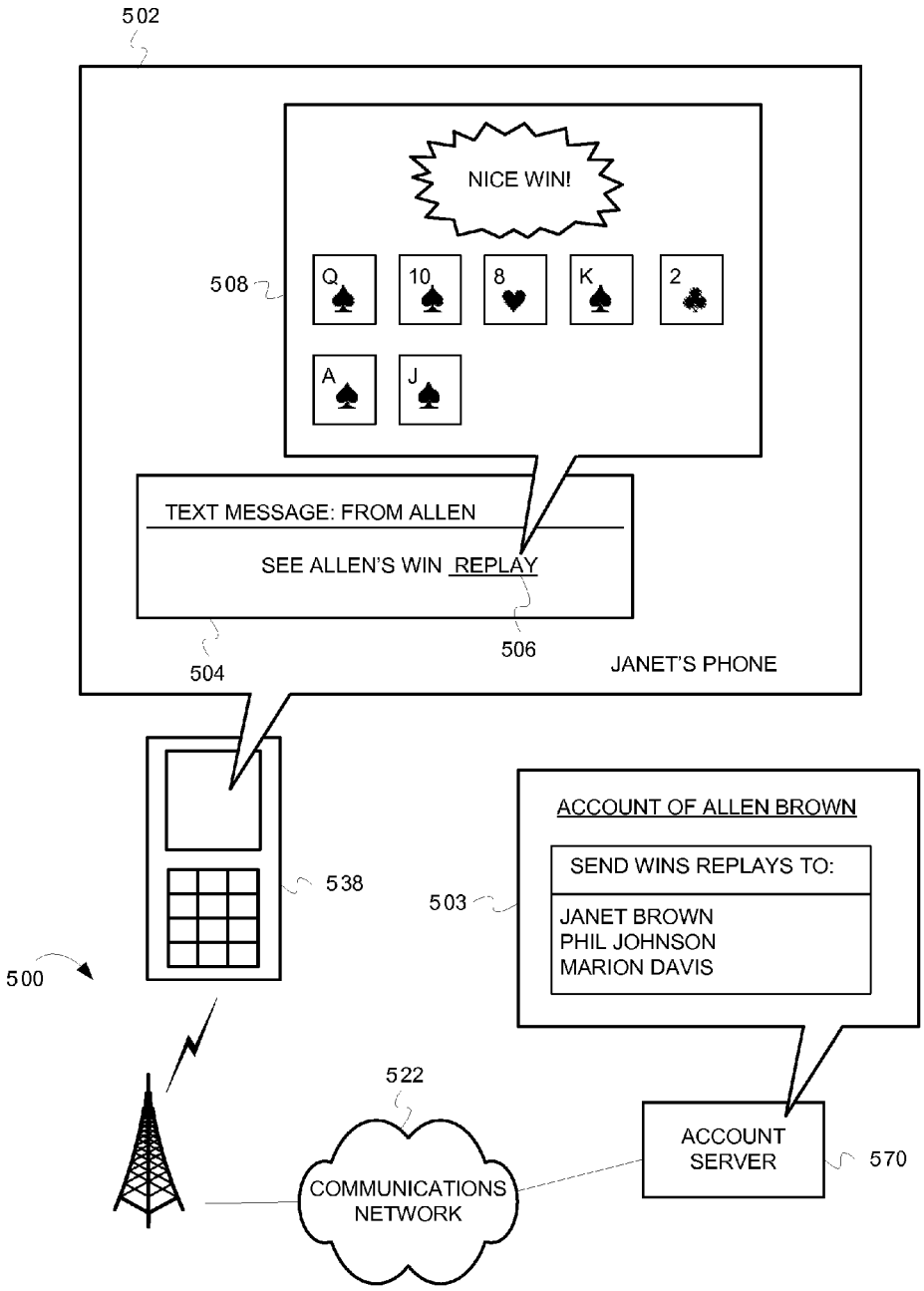
FIG. 5 is an illustration of presenting text messages with gaming content links, according to some embodiments.

FIG. 4 is a flow diagram ("flow") 400 illustrating generating messaging with gaming content links, according to some embodiments. FIG. 5 is a conceptual diagram that helps illustrate the flow of FIG. 4, according to some embodiments. This description will present FIG. 4 in concert with FIG. 5. In FIG. 4, the flow 400 begins at processing block 402, where a wagering game system ("system") determines one or more social network accounts associated with a wagering game player account. The wagering game player account can be associated with a wagering game network that provides wagering games. The one or more social network accounts can be associated with one or more social networks. The one or more social network accounts and wagering game player account can be related through player settings stored on the wagering game network or on the social network.

The flow 400 continues at processing block 404, where the system determines a wagering game activity and generates a wagering game representation of the wagering game activity. The player account can play the wagering game. The wagering game can produce an interesting activity or result, such as a "win" or a "near win", that the player account wants to share with others accounts (e.g., one or more social contact accounts) associated with the player account (e.g., friends, family, etc.) and/or with the one or more social network accounts associated with the player account. The system can record and store the wagering game activity in a wagering game representation (e.g., a video, an animation, a textual description, a still image, a game element, a link to game information, etc.etc.). The wagering game representation can include a graphical presentation of a portion of a wagering game outcome, any portion of a wagering game session leading up to the outcome, congratulatory displays, textual descriptions of events within the wagering game, a follow-up presentation of an award, a depiction of an award redemption, interviews of a player, and any other information associated with the wagering game.

The flow 400 continues at processing block 406, where the system generates messaging medium content that includes the wagering game representation. For example, the system can embed a link of a wagering game "win" into a text message. FIG. 5 illustrates an example. In FIG. 5, a wagering game system ("system") 500 includes a mobile telephonic client ("mobile client") 538 connected to an account server 570 via a communications network 522. The mobile client 538 can include a display 502. The display 502 presents a text message 504 generated by the system 500. In one embodiment, the text message 504 (e.g., an SMS message) includes a textual statement along with a replay link 506. In some embodiments, the replay link 506 is a written link to a website, an active link to a website, and an active link to a file included with the text message. When activated, the replay link 506 can present a replay presentation 508 of the interesting gaming event (e.g., the "win"). In some embodiments, the replay link 506 can include a graphical control, a button, an animation, sounds, or other objects and multimedia embedded into the text message 504 (e.g., an MMS message). In other embodiments, however, the replay link 506 can be text without graphics or sounds. In some embodiments, the system 500 can integrate an embeddable form of content via a URL "embed" instruction (e.g., a YouTube™ video) into the replay link 506.

The flow 400 continues at processing block 408, where the system determines one or more social contact accounts associated with the social network account and sends the messaging medium content to one or more designated social contact accounts. For instance, in FIG. 5, the account server 570 can be associated with a publish setting 503 associated with a player account. The publish setting 503 can include names of social contacts that will receive the text message 504 produced by the mobile client 538. Returning to FIG. 4, in some embodiments, the system may include a manual publication button that a player account can use to initiate the creation and sending of the messaging medium content. For instance, in FIG. 1, the online casino 130 includes the publishing control 119 that the player account 131 can use to publish wagering game representations to friends (e.g., social contact accounts, cell phone numbers, email addresses, etc.) associated with the player account 131. Returning to FIG. 4, some social contacts can be subscribed to the player's messaging medium content via a social network application that the social contacts use in conjunction with their own social network accounts. In some embodiments, the system can determine settings that indicate the designated social contact accounts. The designated social contact accounts can be a subset of a social contact group stored on the social network account. In some embodiments, the system can automatically post interesting events to sites, groups of friends, etc. via text message, instant message, chat, email, or other forms of electronic social communication and messaging media.

The flow 400 continues at processing block 410, where the system presents the wagering game representation when activated. For example, a social contact can receive the messaging medium content (e.g., receive a text message via a mobile client, receive an instant message via an instant message application, receive a chat message via a social network chat application, etc.). The social contact can activate control information included in the messaging medium content (e.g., click on the embedded link within a text message, click on a screen-shot in an email, etc.). The control information can include meta-data that stores a location of stored content, such as location of a video of the wagering game representation. The system can then present the activated content (e.g., play a video of a wagering game representation). In some embodiments, the system can reveal a wagering game representation slowly (e.g., the system can first show a screen shot of the event associated with wagering game activity and require the recipient to log on to a website, or download software before the recipient can view a video of the event). In other embodiments, the system can present the wagering game representation immediately (e.g., within the messaging medium content, on a player application associated with a mobile device, etc.).

The flow 400 continues at processing block 412, where the system tracks activity of recipients of the messaging medium content. For example, the system can track activity of the one or more social contact accounts that receive and view a messaging medium content (e.g., track activity of friends who click on a video of a wagering game replay). The system can reward the recipient's activity and/or the sender's activity. For example, the system can provide guaranteed prize (e.g., a win, a game enhancement, a promotion, points, fun dollars, etc.) to friends who activates the messaging medium content or reward the sender (e.g., multi-level type marketing points, loyalty points, etc.). In some embodiments, the system can send an email to a recipient with a code included in the text message and/or on the replay presentation. The code can be used to redeem a prize on a wagering game website, a social network website, a third-party affiliate's website, etc. In some embodiments, the system can integrate with an instant buddy list and can set up the buddy list to shows items associated with buddies, such as message, rewards for activity, prizes, replay presentations, etc.

In some embodiments, a wagering game system can integrate with mobile clients in various ways to use messaging medium content and/or integrate wagering game activities in social communications. Below is a list of some possible embodiments:

The system can present a slot-game on multiple mobile clients. When the mobile clients come into close contact (e.g., within a short wireless range, within a predetermined physical distance, within a wireless range for a business, etc.) the system could provide a benefit (e.g., multiplier, bonus, etc.) to the player using the close contact mobile client.

The system can pool together players within a wireless range of mobile clients (e.g., pool the closest number of players to play a group game).

The system can send a group email to multiple players. When the players open the email on a mobile client, the system can launch a group game.

The system can present board-game type wagering game on a mobile client. The mobile client can send in moves for the board-game type wagering game one at a time via text message and receive back results via text message.

The system can present a wagering game with a slow-reveal. For example, the system can present a slot game where a player sends in a text message (e.g., the player sends a text that says "BET 1") and the system sends back a series of txt messages in an order revealing a portion of a wagering game outcome on each text message (e.g., a first txt message says "BAR", a second text message says "BAR", a third text message says "Cherries. Sorry! No win.").

Figure 6:
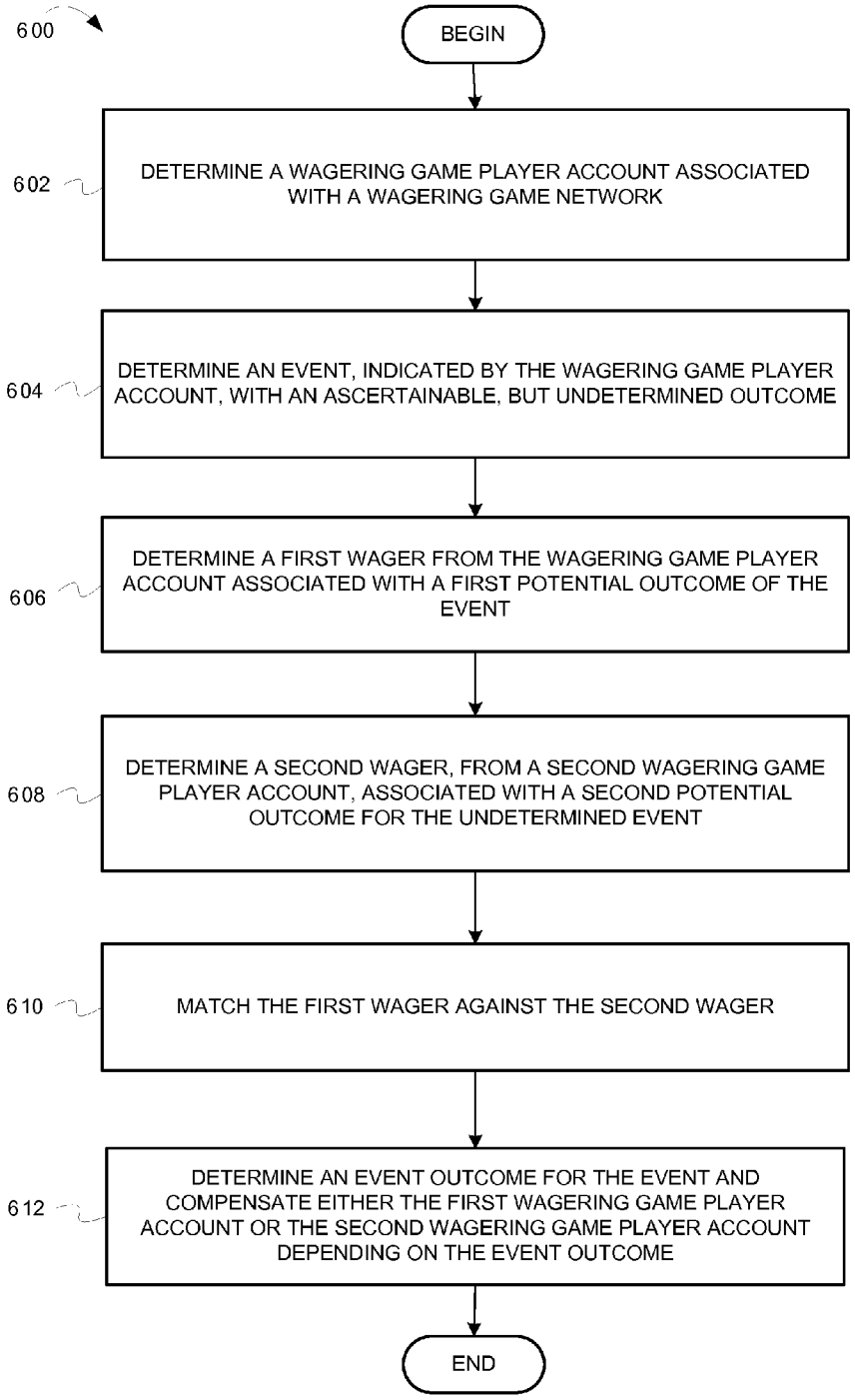
FIG. 6 is a flow diagram 600 illustrating controlling social network betting, according to some embodiments.

FIG. 6 is a flow diagram ("flow") 600 illustrating controlling social network betting, according to some embodiments. In FIG. 6, the flow 600 begins at processing block 602, where a wagering game system ("system") determines a wagering game player account associated with a wagering game network. The system can also determine a social network account associated with the wagering game player account. The social network account can be associated with a social network. The social network account can be utilized in conjunction with the player account.

The flow 600 continues at processing block 604, where the system determines an event, indicated by the wagering game player account, with an ascertainable, but undetermined outcome. The event can be any event (e.g., activity, revealing of an unknown fact, etc.) that has an outcome that is unknown and/or undetermined (i.e., yet to be determined or revealed) to the player account or any other player account betting on the same event. For example, for an event that is an activity, the event is the performance of the activity and the result of the activity is the event's outcome. In another example, for an event that is not an activity, such as revealing an unknown fact, the event is the revealing of the fact, and the fact is the event's outcome. The system will reveal the outcome of the event at a future time to the players. In some embodiments, the event can be any occurrence (e.g., real-world event, game related event, random event, etc.) whose outcome is outside of the control of the player associated with the player account or any other player involved in betting against the player account. For example, the event can include activities such as a wagering game play performed by a third party, weather occurrences, stock values, surveys about something that might happen, sports events, elections, etc. In other embodiments, however, the event can be controlled, at least partially, by the player account or any other player account betting against the player account (e.g., betting on a competition between the player account and other player accounts, betting on who can make the most sales in a month, etc.). The system can provide controls for players to create their own peer-to-peer bets, such as on events that are known and/or of interest only to the peers involved (e.g., will a friend's marriage last, can a friend eat a 50-ounce steak in 10 minutes, etc.). The event can have multiple possible outcomes (i.e., two or more) which the player account, and other player accounts, can bet on. In some embodiments, the betting performed by the player account on any event may be referred to herein as "anytime" betting, as the player is allowed to indicate any event (with an undetermined outcome), at any time, that another player is willing to bet against. The system can include a gambling mechanism that the player account uses to indicate the event and also to place bets and receive outcomes. The gambling mechanism can be any combination of hardware, software, etc., such as an electronic device, a wagering game machine, a computer, a cell phone, a web application, a plug-in, a website user interface, a toolbar, an add-on on a toolbar, a widget (e.g., on a website, on a blog, on a device), a messaging application, or any other mechanism that can facilitate betting between individuals on event outcomes. In some embodiments, the gambling mechanism is a widget on a social network website. For example, in FIG. 1, the web widget 110 can include an "anytime betting" button 125. A player can activate the "anytime betting" button on the web widget 110. The system 100 can cause a betting interface, or betting console 126, to appear. The betting console 126 can have an event control 127 that indicates possible events for the player account to bet on, or in which the player can specify an event with an ascertainable, but undetermined outcome. Returning now to FIG. 6, in some embodiments, the widget can be on a mobile device, such as a cell phone or personal digital assistant. The widget can connect the player account to a wagering game network, or other such gaming venue, that can broker the bets between players on the event. In some embodiments, the system can be a massively multiplayer online (MMO) game. The MMO can be an enormous world of gambling on any event based activity, or non-event activity.

The flow 600 continues at processing block 606, where the system determines a first wager from the wagering game player account associated with a first potential outcome of the event. In some embodiments, the system can wager money, items, points, status, services, rights, virtual assets (e.g., virtual trophies or medals, collected game items, etc.) or any other thing that the betting parties value. For instance, in FIG. 1, the betting console 126 can include betting controls 129 for the player account 131 to place bets. The player account 131 is connected to the social network user account 121 so that the widget can be utilized on the social network website 120 but still have connection to a wagering account. The betting console 126 can also include an outcome control 136 that a player can use to indicate a potential outcome for the event specified in the event control 127. The system 100 can store bets (e.g., money amounts, items, virtual assets, etc.) in a secured escrow account until the system 100 can ascertain the outcome of the event and reveal it to the parties, or until the parties agree on the outcome using the web widget 110. The system 100 can then release the funds in the escrow account to the winning party's account. In some embodiments, the system 100 can integrate with personal banking accounts, non-wagering broker accounts, financial escrow accounts, etc., (e.g., integrate with Pay-Pal™ accounts for the betting parties).

The flow 600 continues at processing block 608, where the system determines a second wager, from a second wagering game player account, associated with a second potential outcome for the undetermined event. For example, the second player account can utilize widget, such as the widget 110 in FIG. 1 to place bets, select potential outcomes, etc. The second player account can also be associated with a second social network account.

The flow 600 continues at processing block 610, where the system matches the first wager against the second wager. In some embodiments, the system can match the first wager and second wager via a wagering control mechanism (e.g., a widget). For example, in FIG. 1, the player account 131 can specify another (e.g., second) player account using a challenger control 128 on the web widget 110. The challenger control 128 can list friends of the player account 131. The list of friends can be social contacts (e.g., social contacts stored by the social network website 120 for the social network user account 121) that have associated player accounts. The system 100 can then match, connect, broker, associate, or otherwise determine that the first wager for the player account 131 competes against a second wager for the other player account indicated in the challenger control 128. The system 100 can function as a broker for the event. In some embodiments, the system 100 can connect the player accounts (e.g., the player account 131 and the challenger account) to a third-party account that controls odds or that brokers the bet. The system 100 can also integrate with third-party peer-to-peer applications or with third-party websites or services that offer gambling.

The flow 600 continues at processing block 612, where the system determines an event outcome for the event and compensates either the first wagering game player account or the second wagering game player account depending on the event outcome. For example, in FIG. 1, the system 100 can ascertain the outcome of the event and reveal it to the parties. The system 100 can then release the funds in the escrow account to the winning party's account. For instance, if the system 100 determines that the outcome matches the potential outcome indicated in the outcome control 136, the system 100 can release the bet (e.g., money amount, item, etc.) from the escrow account to the player account 131. In some embodiments, the system 100 may not be able to electronically ascertain an outcome for the event, but can determine that the parties agree on an outcome using the web widget 110 (e.g., the system 100 accepts a mutual agreement on the outcome from the betting parties and pays out the bet value to the agreed upon winner). Returning now to FIG. 6, in some embodiments, the system 100 can match up more than two bets (e.g., multiple bets, groups of bets, bets on more than two possible outcomes, etc.). In some embodiments, the system can determine that there are more than two possible outcomes for an event. For example, the first player account can bet on one possible outcome, the second player account can bet on a second possible outcome, and the third account (e.g., a third player account, a broker account, a casino "house" account, etc.) bets against the first and second wager for a third, or any alternative outcome. In such a scenario, the system can transact a losing result for both the first wager and the second wager, but a winning result for the third account.

Figure 7:
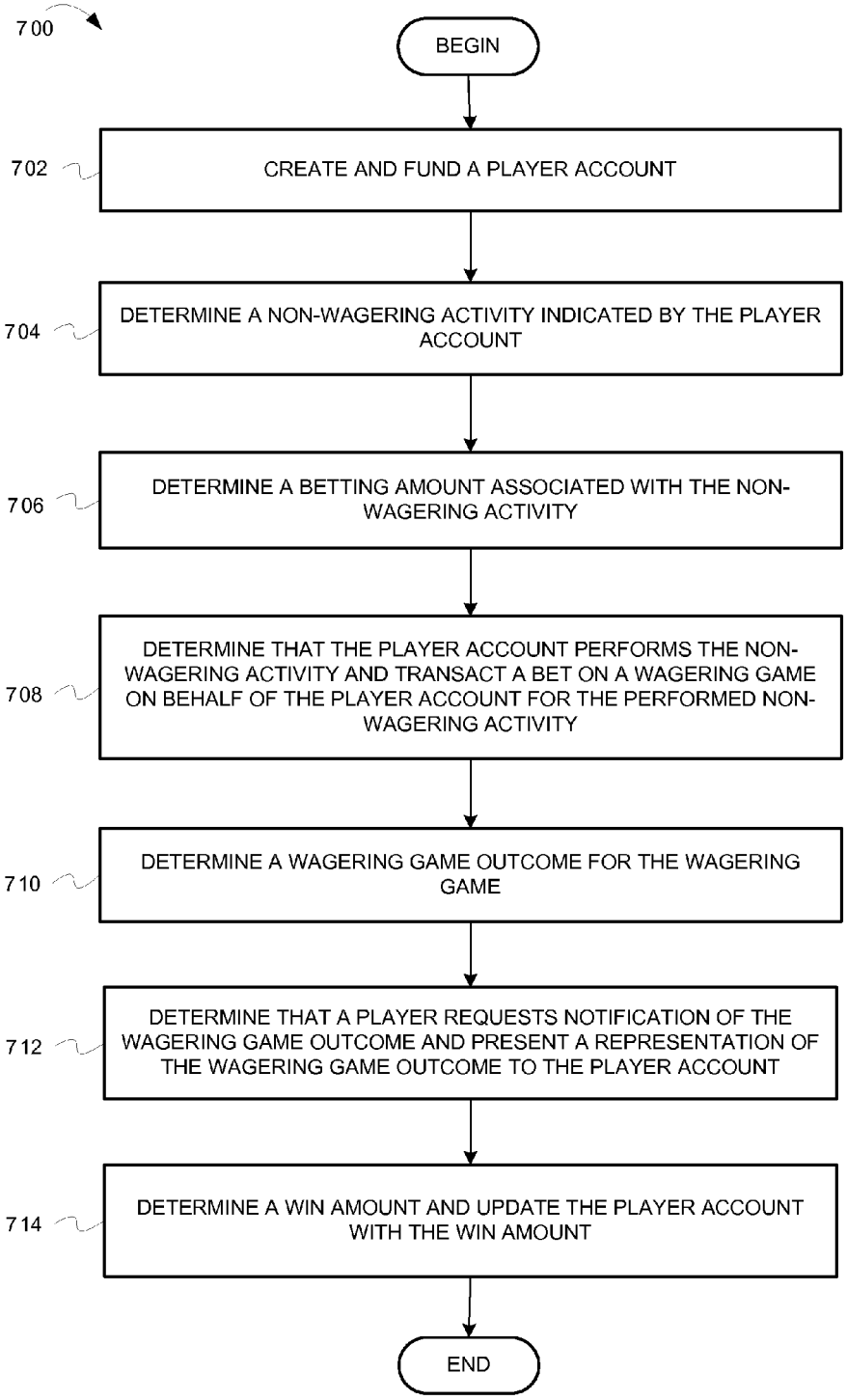
FIG. 7 is a flow diagram 700 illustrating controlling background betting, according to some embodiments.
Figure 8:
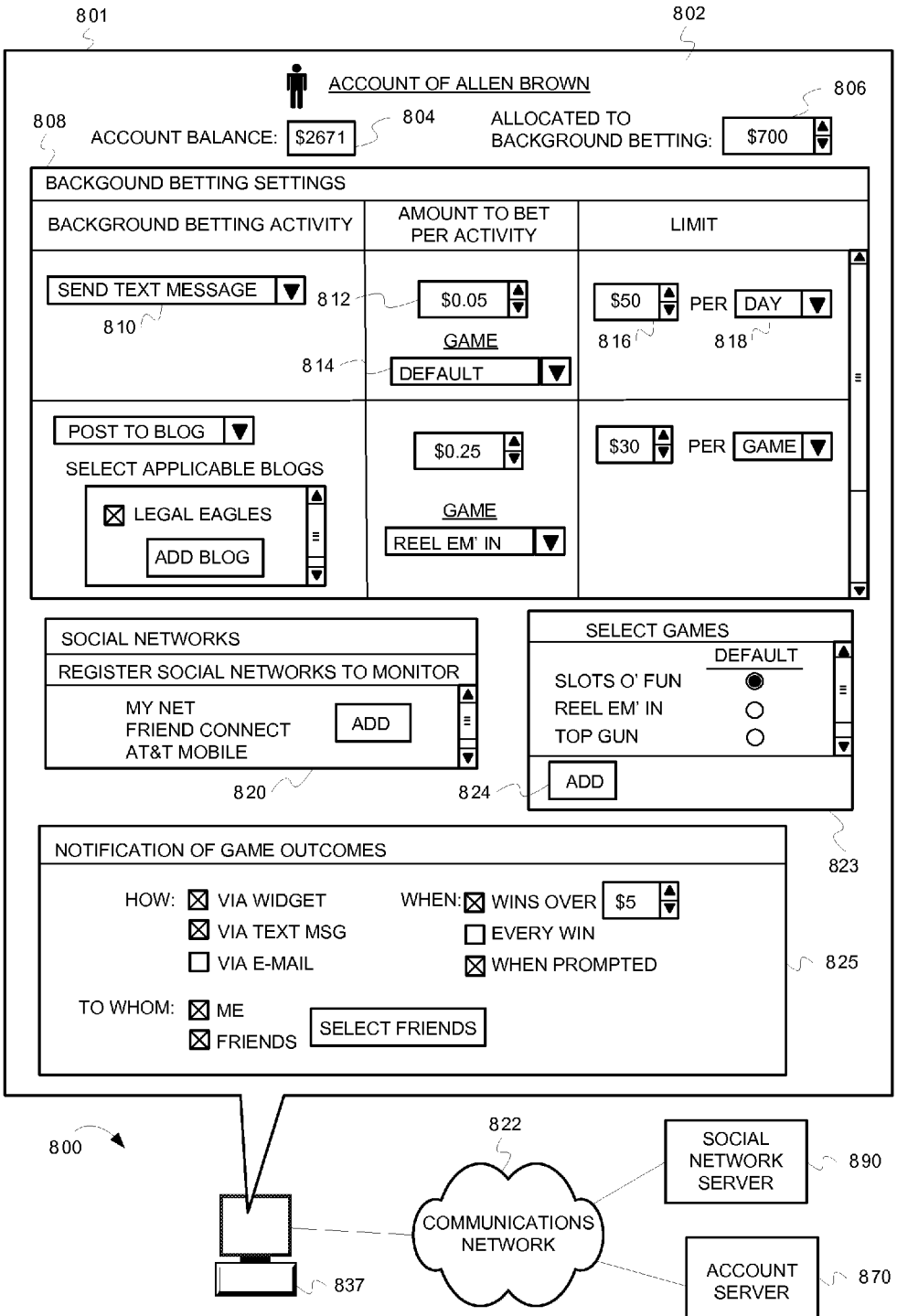
FIG. 8 is an illustration of configuring a wagering game player account with background betting settings, according to some embodiments.

FIG. 7 is a flow diagram ("flow") 700 illustrating controlling background betting, according to some embodiments. FIG. 8 is a conceptual diagram that helps illustrate the flow of FIG. 7, according to some embodiments. This description will present FIG. 7 in concert with FIG. 8. In FIG. 7, the flow 700 begins at processing block 702, where a wagering game system ("system") creates and funds a player account. The player account can be used to perform "background" or non-intrusive, auto-play wagering based on non-wagering activity, such as social communications that the player performs on a regular basis. The system can utilize widgets on social networking websites to configure and perform background betting and game play. In some embodiments, background betting may be referred to as "social network micro gaming" as a streamlined gaming method that performs small, or "micro," background bets and transactions on a player's every-day type activities, adding an element of risk, reward, and fun to the player's normal, non-wagering activities. The background betting can be presented to, and configured by, a player via a social network website (e.g., as in FIG. 1, via the web widget 110 on the social network website 120). The player can perform non-wagering activities via the social network website. However, in some embodiments, the system can utilize a third-party account, network, applications, etc. to facilitate and track wagering activities if the social network website does not, or cannot do so. The system can present funding controls for a player to fund the player account (e.g., deposit money into the account). FIG. 8 illustrates an example. In FIG. 8 a wagering game system ("system") 800 includes a computer system ("computer") 837 connected to a social network server 890 and an account server 870 via a communications network 822. The computer 837 presents a display 801 of a wagering game player account ("player account") 802 (e.g., an account for the player "Allen Brown"). The player account 802 can include an account balance meter 804 indicating a money balance for the player account 802 to utilize on wagering. The player account 802 can also include a background betting control 806 that the player account 802 can utilize to allocate a specific amount of the account balance to background betting. The background betting control 806 can indicate an overall limit, or cap, of funds that could be used for background betting. The system 800 can also provide controls and settings that allow the player to specify automatic increases or decreases to the limit.

The flow 700 continues at processing block 704, where the system determines a non-wagering activity indicated by the player account. In some embodiments, the non-wagering activity can be a social-communication activity, such as chatting with a friend via the internet, posting a blog entry, sending a text message, making an update to a social network account, configuring blog aggregation, making a telephone call, sending an email, etc.). In other embodiments, the non-wagering activity can be other non-wagering activity that the account owner can perform electronically and/or that can be reported, or tracked (e.g., trackable, traceable, etc.) electronically (e.g., visiting a website, completing a work goal, emailing a specific person(s), making a personal phone call to a specific person(s), making a sales call, making a discounted purchase, making a deposit into bank savings account, etc. The system can provide a gambling mechanism or device that a player can use to indicate the non-wagering activity. In some embodiments, the gambling mechanism can be a social network website, a social network application, a mobile device, etc. In some embodiments, the gambling mechanism can be a web widget that controls background wagering for the performance of the non-wagering activity. For example, in FIG. 1, the web widget 110 can be used to configure background betting and track non-wagering activities. The web widget 110 can also transact bets and/or send reports of the non-wagering activity to the online gaming server 150 to transact bets. In some embodiments, the system 800 can track non-wagering activity performance mechanisms, such as social communications mechanism (e.g., social network websites, mobile communication devices, website applications, communications networks, etc.) that a player has registered to be monitored for the non-wagering activity. For instance, the player account 802 can include a social networks console 820 that an account owner can use to register the social network websites and wireless communication networks to monitor for performance of social communication activities (e.g., blog posts, social network website updates, text messages, etc.).

The flow 700 continues at processing block 706, where the system determines a betting amount associated with the non-wagering activity. The system can present configuration controls for the player account to use to indicate games on which to bet, place bet amounts for a game, set pay lines, specify game denomination, etc. For instance, in FIG. 8, the system 800 presents a background settings console 808 that includes a non-wagering activity control 810 that indicates an activity for which the system 800 will place a micro bet when performed. The background settings console 808 can also include a bet amount control 812 that a player can use to specify an amount to bet per each activity performed specified in the non-wagering activity control 810. The background settings console 808 can also include a game specification control 814 to indicate a game on which to place the bet amount indicated by the bet amount control 812. The player account 802 can also include a master game selection console 823, with a game addition control 824 that a player can use to select games that appear in dropdowns for the game specification control 814. The master game selection console 823 can also include controls to set a default game. In some embodiments, the system 800 can assign varying betting values to the different activities. For example, one setting indicates that when a player sends a text message, the system 800 will bet $0.05, which is a lower amount set by the player account 802 as the player may perform that activity more often and may not want to control spending of bets. On the other hand, another setting indicates that when a player posts to a blog, the system 800 will bet $0.25. In some embodiments, the system 800 can enforce a betting limit on the activity and can set up stop activity so that the system 800 stops betting if betting amounts reach a level for an event (e.g., a game, a number of wins, etc.) or a period (e.g., a gaming session, a chatting session, a day, etc.). For example, the background settings console 808 can include a total bet control 816 to specify a limit amount and a period/event indicator 818 to specify the event or period for which to monitor the limit amount indicated in the total bet control 816. In some embodiments, the system 800 can determine activities that would raise or lower the limits (e.g., system determines that a player authorizes a temporary lift of the limits, the system determines that the player has a low average of performing triggering non-wagering events per specified period and automatically lifts the limit until the average increases to a predetermined level, the system recognizes that the underlying wagering game provides a bet multiplier that increases bet amounts, etc.).

The flow 700 continues at processing block 708, where the system determines that the player account performs the non-wagering activity and transacts a bet on a wagering game on behalf of the player account for the performed non-wagering activity. For example, the player can perform a social communication activity, such as posting a blog comment, or sending a text message. The system place a bet for the activity. The system can enable a turn or play for a wagering game (e.g., cause a wagering game server to play a game, make a spin on a slot game, play a hand at poker, etc.). For each play, or turn, the system can send an encrypted message to the wagering game server and select a wagering game specified from the player's settings or select a default game if the player did not specify a specific wagering game. The system can use a bet indicated by the players setting for the non-wagering activity and play the turn on the specified game for the bet amount. In some embodiments, the system can award bets for performing specific social network activity (e.g., a social network website can award micro bets for removing friends from crowded friend lists, recruiting new users, etc.). The system places, or transacts, the bet on the wagering game in the background, meaning that the player does not perform the betting activities directly, nor does the player activate the game play directly. The system automatically causes the bet and game play to occur based on the non-wagering activity that the player performed. The system can determine that the player account performs the non-wagering activity via electronic tracking For example, a wagering game server can electronically determine that a player performs an activity using a client (e.g., makes a blog comment) by tracking specific activity on the client. The player account may have indicated specific activity to watch for. The system (e.g., via a mail server, an account server, a bank server, a communications server, etc.) may also report activity back to a wagering game server so that the wagering game server can determine that the non-wagering activity occurred. Accounts associated with the multiple servers can include user settings that indicate activity that should be monitored and reported.

The flow 700 continues at processing block 710, where the system determines a wagering game outcome for the wagering game. After the system enables the turn or play, the system can determine (e.g., generate) a game outcome (e.g., a win, a loss, a bonus, etc.) and communicate the outcome to the player account (e.g., via the gambling mechanism). The system can store the wagering game outcome for subsequent viewing and/or for record keeping. For example, the system can store a specified number of game outcomes (e.g., the last 100 game outcomes) that the player can access via the gambling mechanism.

The flow 700 continues at processing block 712, where the system determines that a player requests notification of the wagering game outcome and presents a representation of the wagering game outcome to the player account. For example, the system can determine that the player account accesses the gambling mechanism and requests to view the wagering outcome, and any other previous wagering game outcomes. The system can presents a representation (e.g., a display, a textual description, etc.) of the wagering game outcome on the gambling mechanism. For example, a player may periodically check a web widget and review a history of the background bets and any wins. The player can also access replays of the wins. In some embodiments, the system can present a real-time display of results, counters, peripheral indicators, etc. In some embodiments, the system can only present the results of the background betting and game play when the player account accesses the gambling mechanism (e.g., only when a player logs on to a social network website and launches a web widget). In other embodiments, the system can notify the player via other means. For instance, in FIG. 8, the player account 802 may include a notifications console 825 for a player account to specify notification settings. The notifications console 825 can include controls for how, when, and to whom notifications can be sent (e.g., controls to specify that notifications should be sent by widget display, text message, email, etc., controls to specify friends to whom to send the notifications, controls to indicate when notifications should be sent, etc.)

The flow 700 continues at processing block 714, where the system determines a win amount and updates the player account with the win amount. The system can determine if the game outcomes result in wins and can transact the win amounts to the player account. In some embodiments, the system can determine that a player's funds are depleted (e.g., an account balance is at $0). The system, however, can continue to play for the player account and generate wagering game outcomes. The system can, in some embodiments, lend money to the player to transact the bets. In other embodiments, the system determine wins that the player might have won had the account been funded. In some embodiments, the system can present gaming history to friends, track recruitment of friends, award recruitment of friends, and so forth.

Additional Example Operating Environments

This section describes example operating environments, systems and networks, and presents structural aspects of some embodiments.

Computer System

Figure 9:
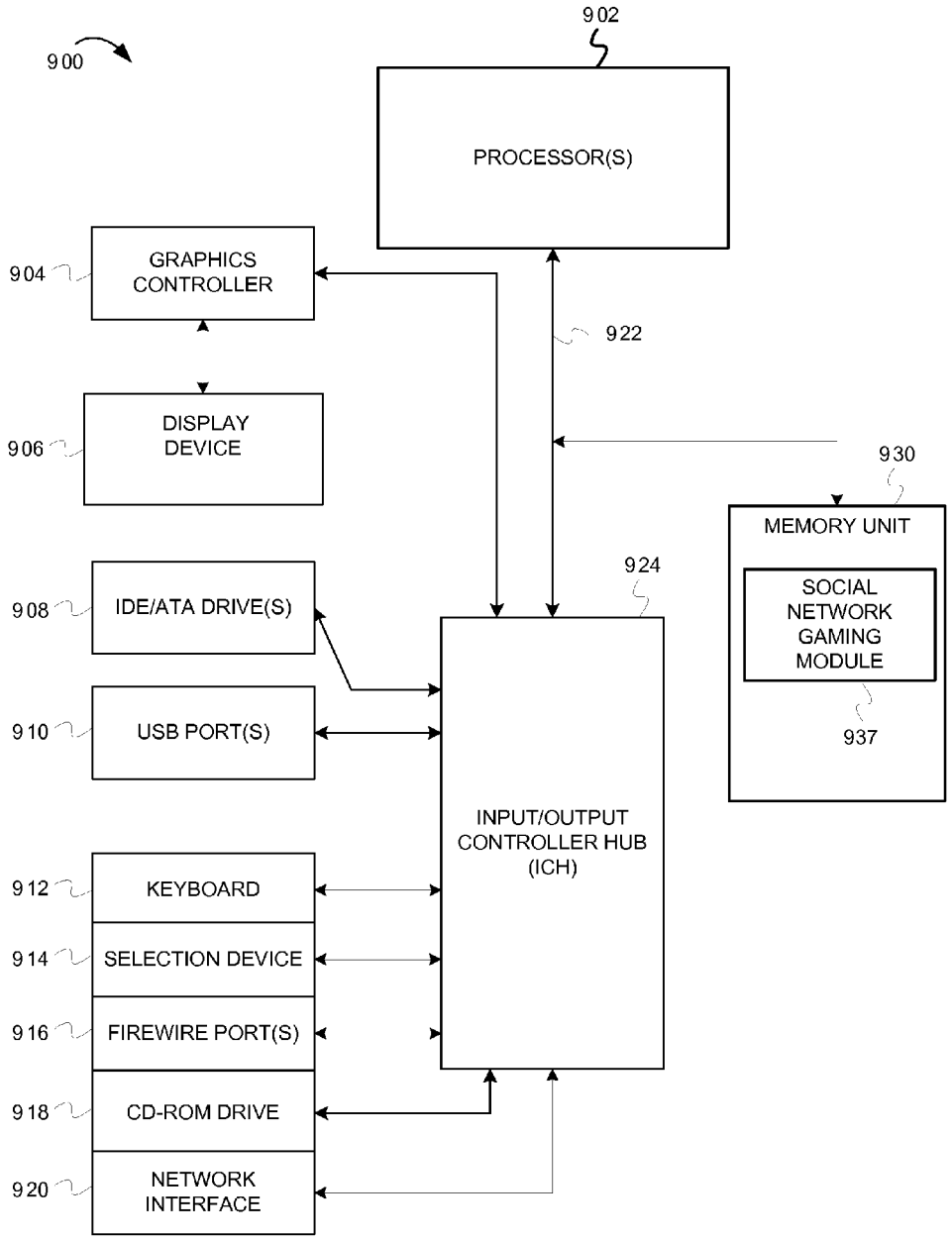
FIG. 9 is an illustration of a computer system 900, according to some embodiments.

FIG. 9 is a conceptual diagram that illustrates an example of a computer system 900, according to some embodiments. In FIG. 9, the computer system 900 may include a processor unit 902, a memory unit 930, a processor bus 922, and an Input/Output controller hub (ICH) 924. The processor unit 902, memory unit 930, and ICH 924 may be coupled to the processor bus 922. The processor unit 902 may comprise any suitable processor architecture. The computer system 900 may comprise one, two, three, or more processors, any of which may execute a set of instructions in accordance with some embodiments.

The memory unit 930 may also include an I/O scheduling policy unit 9 and I/O schedulers 9. The memory unit 930 can store data and/or instructions, and may comprise any suitable memory, such as a dynamic random access memory (DRAM), for example. The computer system 900 may also include one or more suitable integrated drive electronics (IDE) drive(s) 908 and/or other suitable storage devices. A graphics controller 904 controls the display of information on a display device 906, according to some embodiments.

The input/output controller hub (ICH) 924 provides an interface to I/O devices or peripheral components for the computer system 900. The ICH 924 may comprise any suitable interface controller to provide for any suitable communication link to the processor unit 902, memory unit 930 and/or to any suitable device or component in communication with the ICH 924. The ICH 924 can provide suitable arbitration and buffering for each interface.

For one embodiment, the ICH 924 provides an interface to the one or more IDE drives 908, such as a hard disk drive (HDD) or compact disc read only memory (CD ROM) drive, or to suitable universal serial bus (USB) devices through one or more USB ports 910. For one embodiment, the ICH 924 also provides an interface to a keyboard 912, selection device 914 (e.g., a mouse, trackball, touchpad, etc.), CD-ROM drive 918, and one or more suitable devices through one or more firewire ports 916. For one embodiment, the ICH 924 also provides a network interface 920 though which the computer system 900 can communicate with other computers and/or devices.

The computer system 900 may also include a machine-readable medium that stores a set of instructions (e.g., software) embodying any one, or all, of the methodologies for integrate social networks and wagering games. Furthermore, software can reside, completely or at least partially, within the memory unit 930 and/or within the processor unit 902. The computer system 900 can also include a social network gaming module 937. The social network gaming module 937 can process communications, commands, or other information, to integrate social networks and wagering games. Any component of the computer system 900 can be implemented as hardware, firmware, and/or machine-readable media including instructions for performing the operations described herein.

Wagering Game Machine Architecture

Figure 10:
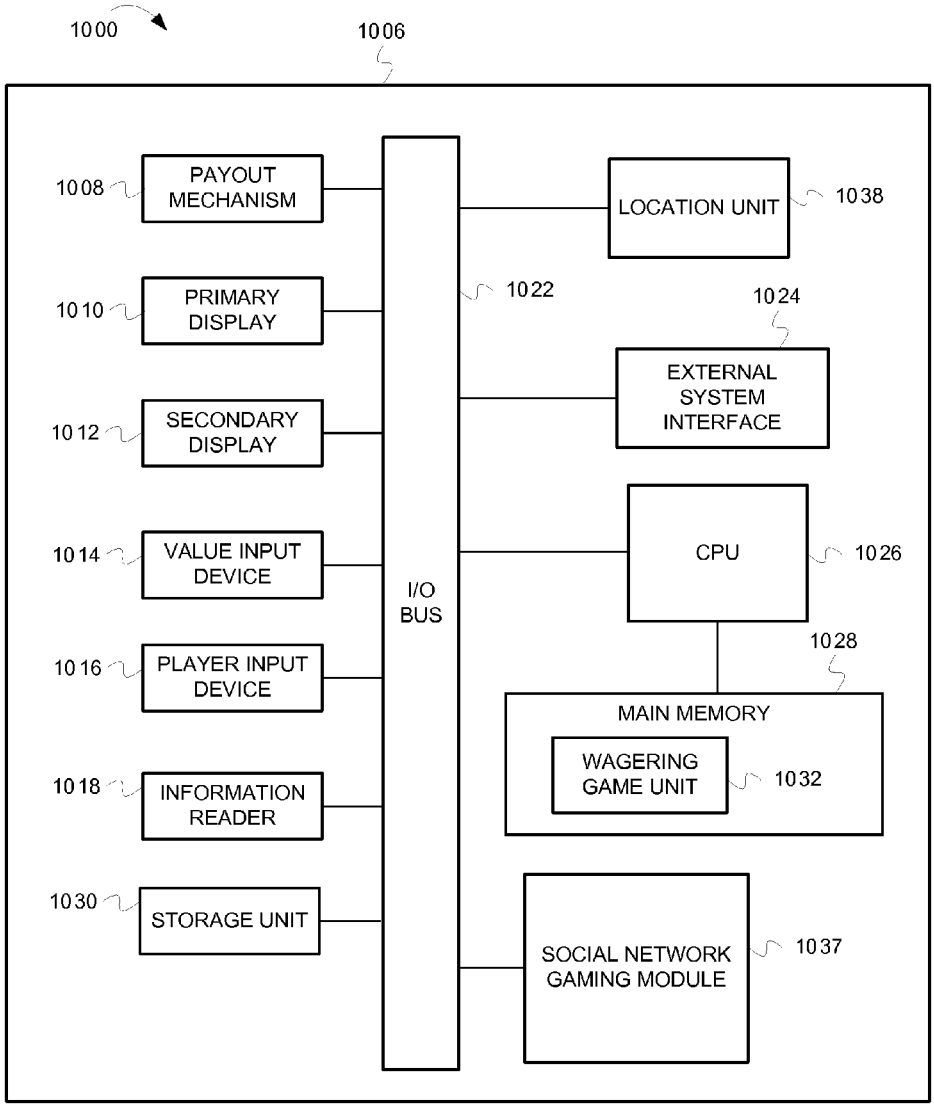
FIG. 10 is an illustration of a wagering game machine architecture 1000, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In some embodiments, the wagering game unit 1032 can present wagering games, such as video poker, video black jack, video slots, video lottery, reel slots, etc., in whole or part.

The CPU 1026 is also connected to an input/output ("I/O") bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems (e.g., wagering game networks). The external system interface 1024 can include logic for exchanging information over wired and wireless networks (e.g., 802.11g transceiver, Bluetooth transceiver, Ethernet transceiver, etc.)

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes a social network gaming module 1037. The social network gaming module 1037 can process communications, commands, or other information, where the processing can integrate social networks and wagering games.

Furthermore, any component of the wagering game machine 1006 can include hardware, firmware, and/or machine-readable media including instructions for performing the operations described herein.

Wagering Game Machine

Figure 11:
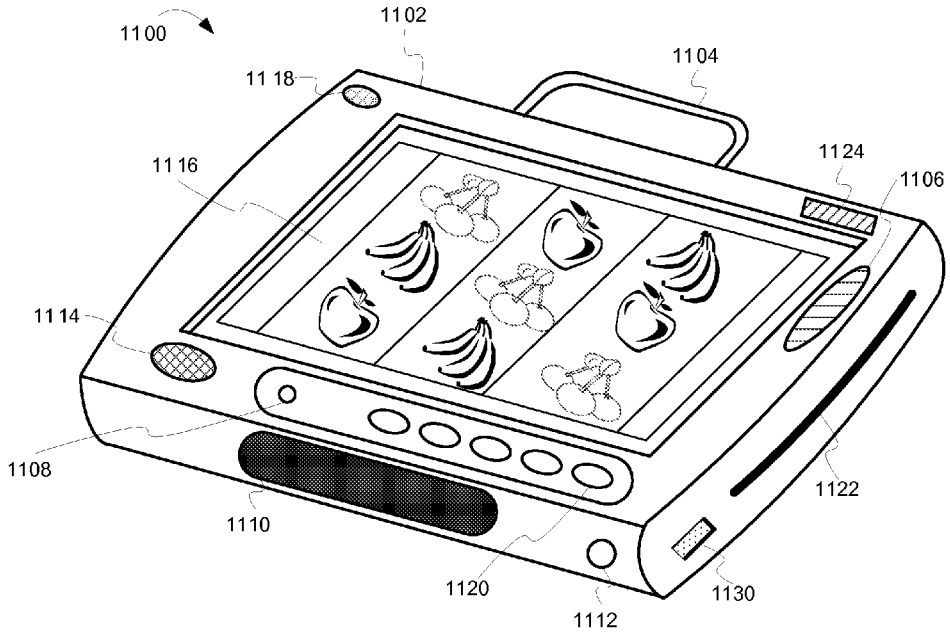
FIG. 11 is an illustration of a wagering game machine 1100, according to some embodiments.

FIG. 11 is a conceptual diagram that illustrates an example of a wagering game machine 1100, according to some embodiments. In FIG. 11, the mobile wagering game machine 1100 includes a housing 1102 for containing internal hardware and/or software such as that described above vis-à-vis FIG. 10. In some embodiments, the housing has a form factor similar to a tablet PC, while other embodiments have different form factors. For example, the mobile wagering game machine 1100 can exhibit smaller form factors, similar to those associated with personal digital assistants. In some embodiments, a handle 1104 is attached to the housing 1102. Additionally, the housing can store a foldout stand 1110, which can hold the mobile wagering game machine 1100 upright or semi-upright on a table or other flat surface.

The mobile wagering game machine 1100 includes several input/output devices. In particular, the mobile wagering game machine 1100 includes buttons 1120, audio jack 1108, speaker 1114, display 1116, biometric device 1106, wireless transmission devices (e.g., wireless communication units 1112 and 1124), microphone 1118, and card reader 1122. Additionally, the mobile wagering game machine can include tilt, orientation, ambient light, or other environmental sensors.

In some embodiments, the mobile wagering game machine 1100 uses the biometric device 1106 for authenticating players, whereas it uses the display 1116 and the speaker 1114 for presenting wagering game results and other information (e.g., credits, progressive jackpots, etc.). The mobile wagering game machine 1100 can also present audio through the audio jack 1108 or through a wireless link such as Bluetooth.

In some embodiments, the wireless communication unit 1112 can include infrared wireless communications technology for receiving wagering game content while docked in a wager gaming station. The wireless communication unit 1124 can include an 802.11G transceiver for connecting to and exchanging information with wireless access points. The wireless communication unit 1124 can include a Bluetooth transceiver for exchanging information with other Bluetooth enabled devices.

In some embodiments, the mobile wagering game machine 1100 is constructed from damage resistant materials, such as polymer plastics. Portions of the mobile wagering game machine 1100 can be constructed from non-porous plastics which exhibit antimicrobial qualities. Also, the mobile wagering game machine 1100 can be liquid resistant for easy cleaning and sanitization.

In some embodiments, the mobile wagering game machine 1100 can also include an input/output ("I/O") port 1130 for connecting directly to another device, such as to a peripheral device, a secondary mobile machine, etc. Furthermore, any component of the mobile wagering game machine 1100 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method for a wagering game system to use a result of a social network game from a social network system as a basis for wagers in the wagering game system, the method comprising:

granting, by the wagering game system via a casino webpage, access to a wagering game player account on the wager gaming system;

after the granting access, determining, by the wagering game system, social network account log-in credentials stored in association with the wagering game player account;

logging-in, by the wagering game system, to a social network account on the social network system using the social network account log-in credentials;

identifying, by the wagering game system, the social network game, from a plurality of social network games available from the social network account;

requesting, by the wagering game system, initiation of the social network game from the social network account, wherein the social network game can be played on the social network system without a monetary wager;

presenting, by the wagering game system, the social network game for play, wherein the social network game is embedded in the casino webpage;

presenting, by the wagering game system, gaming features for wagering on the result of the social network game in the casino webpage;

recording, by the wagering game system and in association with the wagering game player account, a wager on the result of the social network game;

determining, by the wagering game system, the result of the social network game; and settling, in the wagering game player account, the wager based on the result of the social network game.

2. The method of claim 1, wherein the social network game is a multi-player game involving a plurality of social network accounts including the social network account.

3. The method of claim 1 further comprising:

transmitting, to the social network account, player inputs made to the wagering game player account for the social network game.

4. The method of claim 1, wherein the social network game is a skill-based game.

5. The method of claim 1, wherein the wagering game system includes a wagering game server and at least one web widget operating on a computing device, and wherein the web widget performs the logging-in, the identifying, the requesting, and the presenting.

6. The method of claim 1 further comprising:

requesting, by the wagering game system, social network media from the social network account; and presenting, by the wagering game system, the social network media in the casino webpage.

7. The method of claim 6, wherein the social network media includes one or more of photos, text messages, video content, and audio content originating from other social network accounts associated with the social network account.

8. The method of claim 1, further comprising:

presenting, by the wagering game system via the casino webpage, a listing of the plurality of social network games available for play; and receiving, by the wagering game system via the casino webpage, a selection of the social network game from the listing.

9. The method of claim 1 wherein the wager is for one of a default amount; or an amount prompted for and received by the casino webpage.

10. A non-transitory computer-readable medium including instructions, that when executed by one or more processors, perform operations for connecting a wagering game system to a social network system, the instructions comprising:

instructions to grant, by the wagering game system, access to a player account on the wagering game system, wherein the player account includes social network account log-in credentials for accessing a social network account on the social network system, wherein a request for the grant is received via a casino interface;

instructions to log-in, by the wagering game system, to the social network account on the social network system using the social network account log-in credentials;

instructions to identify, by the wagering game system, a social network game available from the social network account wherein the social network game is playable without a monetary wager on the social network system;

instructions to request, by the wagering game system, initiation of the social network game on the social network account;

instructions, to present, by the wagering game system, the social network game for play, wherein the social network game is embedded in the casino interface;

instructions, to present, by the wagering game system, gaming features for wagering on the result of the social network game in the casino interface;

instructions to book, via the gambling features, a wager on behalf of the player account, wherein the wager is based on a result of the social network game;

instructions to determine, by the wagering game system, the result of the social network game; and instructions to settle, in the player account on the wagering game system, the wager based on the result of the social network game.

11. The non-transitory computer-readable medium of claim 10, wherein the instructions to grant access to the player account include instructions to receive log-in credentials associated with the player account, and wherein the log-in credentials identify the player account.

12. The non-transitory computer-readable medium of claim 10, wherein the result of the social network game is a non-monetary score of the social network game awarded by the social network system.

13. The non-transitory computer-readable medium of claim 10, wherein the social network system does not track monetary wagers relating to social network games.

14. The non-transitory computer-readable medium of claim 10, wherein the instruction to settle, in the player account on the wagering game system, the wager based on the result of the social network game includes at least one of instructions to debit funds from the player account; and instructions to credit funds to the player account.

15. The non-transitory computer-readable medium of claim 10, wherein the social network game is one of a skill-based game, and a game of chance.

16. The non-transitory computer-readable medium of claim 10, wherein the social network game is a multi-player game involving a plurality of social network accounts including the social network account.

17. An wagering game system including:

one or more processors;

a memory device including instructions for causing the wagering game system to use results of a social network game from a social network system as a basis for wagers in the wager gaming system, wherein the instructions, when executed by one of the one or more processors, cause the processor to perform operations comprising:

granting, by the wagering game system via a casino interface, access to a wagering game player account on the wager gaming system;

after the granting access, determining, by the wagering game system, social network account log-in credentials stored in association with the wagering game player account;

connecting, by the wagering game system, to a social network account on the social network system using the social network account log-in credentials;

identifying, by the wagering game system, a social network game available from the social network account;

recording, by the wagering game system and in association with the wagering game player account, a wager based on the results of the social network game;

requesting, by the wagering game system, initiation of the social network game on the social network account wherein the social network game is played without monetary wagers when played on the social network system;

presenting, by the wagering game system, the social network game for play, wherein the social network game is embedded in the casino interface;

presenting, by the wagering game system, gambling features for wagering on the result of the social network game in the casino interface;

recording, by the wagering game system and in association with the wagering game player account, a wager on the result of the social network game;

determining, by the wagering game system, the results of the social network game; and settling, in the wagering game player account, the wager based on the results of the social network game.

18. The wagering game system of claim 17, wherein the social network game is a multi-player game involving a plurality of social network accounts including the social network account.

19. The wagering game system of claim 17, the operations further comprising:

transmitting, by the wagering game system to the social network account, player inputs made to the wagering game player account for the social network game.

20. The wagering game system of claim 17, wherein the social network game is a skill-based game.

* * * * *